United States Patent [19]

Tanji et al.

[11] Patent Number: 4,945,034

[45] Date of Patent: Jul. 31, 1990

[54] SILVER HALIDE PHOTOGRAPHIC LIGHT-SENSITIVE MATERIAL

[75] Inventors: Masaki Tanji; Toyoki Nishijima, both of Odawara, Japan

[73] Assignee: Konica Corporation, Tokyo, Japan

[21] Appl. No.: 301,612

[22] Filed: Jan. 24, 1989

[30] Foreign Application Priority Data

Jan. 28, 1988 [JP] Japan ..... 63-18907

[51] Int. Cl.[5] ..... G03C 7/38

[52] U.S. Cl. ..... 430/546; 430/549; 430/551; 430/558

[58] Field of Search ..... 430/558 R, 551, 549, 430/546

[56] References Cited

U.S. PATENT DOCUMENTS

| | | | |
|---|---|---|---|
| 4,665,015 | 5/1987 | Iijima et al. | 430/558 |
| 4,675,275 | 6/1987 | Nishijima et al. | 430/558 |
| 4,710,453 | 12/1987 | Hirabayashi et al. | 430/558 |
| 4,735,893 | 4/1988 | Morigaki et al. | 430/558 |

*Primary Examiner*—Richard L. Schilling
*Attorney, Agent, or Firm*—Jordan B. Bierman

[57] ABSTRACT

A silver halide photographic light-sensitive material is disclosed, which has excellent characteristics peculiar to pyrazoloazole type magenta couplers and yet good suitability to rapid processing, and shows improvement in the gradiation in respect of softening at the toe portion of characteristic curve thereof without impairment of the image preservability and other photographic properties. The photographic material comprises a support having thereon a silver halide emulsion layer containing a silver halide grain having a silver chloride content of not less than 90 mole %, a compound represented by the following Formula I, and a compound capable of deactivating the oxidized product of a color developing agent with a relative reaction rate of not less than 1.6;

Formula I wherein $R_1$, $R_2$ and $R_3$ each represent a substituent other than hydrogen atom, which may be the same as or different from each other; Z represents a group of non-metal atoms necessary for completing a heterocyclic ring which may have a substituent; X represents a hydrogen atom or a group capable of being split off upon reaction with the oxidized product of a color developing agent.

13 Claims, No Drawings

SILVER HALIDE PHOTOGRAPHIC LIGHT-SENSITIVE MATERIAL

FIELD OF THE INVENTION

The present invention relates to silver halide photographic light-sensitive materials and, more particularly, to materials of this kind which have been improved in gradation at the toe portion of the characteristic curve thereof without impairment of the image preservability and have good color reproducibility.

BACKGROUND OF THE INVENTION

It has been great problems that the use of couplers of the 5-pyrazolone type for formation of magenta dyes, which has been in conventional practice, involves secondary absorption in the dye formed, a detrimental factor in color reproduction, in the region of 430 nm, and yellowing (hereinafter referred to as "Y-stain") of the non-colored portion under influence of heat and/or moisture To solve this problems it has been proposed to use various magenta couplers, for example, pyrazolobenzimidazoles described in British Patent No. 1,047,612, indazolones in U.S. Pat. No. 3,770,447, and pyrazoloazoles in U.S. Pat. No. 3,725,067, British Nos. 1,252,418 and 1,334,515, Japanese Patent Publication Open to Public Inspection (hereinafter referred to as "Japanese Patent O.P.I. Publication") Nos. 59-162548/1984 and 59-171956/1984, etc. Indeed by the use of these couplers the secondary absorption of the dyes in the region of 430 nm has become reduced to a very slight degree, and the Y-stain caused by heat and/or moisture is observed but very slightly in the products.

Dyes produced by using said pyrazoloazole-type couplers have excellent properties as mentioned above, especially markedly when used in color papers.

However, differring from the 5-pyrazolone-type couplers which have been in conventional use, the use of couplers based on pyrazoloazole is accompanied with a tendency to make the gradation of the images soft at the toe portion of the characteristic curve. In color photosensitive materials, this tendency shows as disharmony of the gradations among the red-sensitive, green-sensitive and blue-sensitive layers, in many cases with prominence of magenta at the highlight, and brings about a phenomenon generally referred to as 'pinkish highlight' in the case of color prints. Since man's sense of sight is capable of discriminating such delicate inconsistency especially in low density areas, this tendency to 'pinkish highlight' is seriously detrimental to the commercial value of the product.

There have been various approaches to establishment of methods to control the gradation of images in silver halide photographic materials. Some of these approaches which sought general applicability are by changing the coating quantities of the silver halide or coupler, by changing the quantitative ratio of the silver halide to the coupler in the coating, by mixing two or more kinds of silver halide emulsions which differ from each other in grain size or sensitizing method as described in Japanese Patent O.P.I. Publication Nos. 50-71320/1975, 53-44016/1978, 56-78831/1981, 57-58137/1982, 57-150841/1982, 57-178235/1982 and 58-14829/1983, by chemically sensitizing or color sensitizing the silver halide grains by the use of additives, treating condition, and the like especially selected to make the gradation at the toe contrasty, and by the use of a water-soluble salt of rhodium as an additive in forming silver halide grains as described, for example, in Japanese Patent O.P.I. Publication Nos. 52-11029/1977 and 52-18310/1977, British Patent No. 1,535,016, and U.S. Pat. No. 3,448,709.

The methods devised by these approaches, such as the examples referred to above, however; involve possibilities that the gradation may become contrasty even at the shoulder of the characteristic curve as well as at the toe portion and moreover the photographic properties in other respects may be affected as well.

In other approaches, it has been proposed to use certain special compounds as additives for the purpose of redressing the fault of the gradation at the toe portion, for example, as described in Japanese Patent O.P.I. Publication Nos. 61-267050/1986, 62-169159/1987 and 62-172358/1987, but not only is the effect insufficient but the use impairs the image preservability and especially markedly the light fastness.

On the other hand, rapidness has been such a requirement in processing of photographis that it is no longer unusual for processing orders brought in to have to be returned to the customers within a matter of several hours. To meet this requirement for rapid processing, adaptation of both the photosensitive materials and the processing condition has been under consideration. For color development, it has been considered to use high temperatures, to raise pH, to increase the concentration of color developing agents, to use additives such as development accelerator, and so on. Examples of development accelerators for this purpose are 1-phenyl-4-pyrazolidone mentioned in British Patent No. 811,185, N-methyl-p-aminophenol mentioned in U.S. Pat. No. 2,417,514, and N,N,N'',N'-tetramethyl-p-phenylenediamine mentioned in Japanese Patent O.P.I. Publication No. 50-15554/1975. These methods, however, are not quite satisfactory in speeding up the processing and even impair, in many cases, the photographic properties, for example, intensifying the liability to fogging.

In this connection, it is known that the shape, size and composition of the silver halide grains in the silver halide emulsion used in a photosensitive material have a great influence upon the developing speed, and the like. Especially the influence of the halogen composition is known to be outstanding and the developing speed is shown to be greatest when a silver halide with a high silver chloride content is used.

A serious problem arises, however, when a pyrazoloazole-type coupler is used in an emulsion containing silver chloride in a high ratio, since this combination makes the softness of the gradation at the toe portion more conspicuous. Accordingly, development of some technique to improve pyrazoloazole-type couplers in gradation characteristic at the toe portion without impairing the other photographic properties has been awaited in the hope of making them applicable to photosensitive materials for rapid processing.

SUMMARY OF THE INVENTION

With the aforementioned problems taken into consideration the present invention has for its object to provide silver halide photographic materials which have the excellent characteristics peculiar to pyrazoloazole-type magenta couplers and yet good suitability to rapid processing, and show improvement in the gradation characteristic in respect of softening at the toe portion of the characteristic curve without impairment of the image preservability and other photographic properties.

The above-mentioned object of this invention can be accomplished by producing a silver halide photographic light-sensitive material comprising a support thereon at least one silver halide emulsion layer containing a silver halide grain having a silver chloride content of not less than 90 mol %, a compound represented by the following formula I, and a compound capable of deactivating the oxidation product of a color developing agent with a relative reaction rate of not less than 1.6.

Formula I

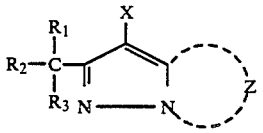

wherein $R_1$, $R_2$ and $R_3$ each represent a radical other than a hydrogen atom, any two or all of which may be the same as or different from each other; Z represents a group of nonmetallic atoms required for forming a heterocyclic ring, which may have a substituent group; X represents a hydrogen atom or a group capable of being split off upon reaction with the oxidation product of a color developing agent.

The present invention will now be described in detail hereunder.

Magenta couplers represented by the Formula I maybe represented by the following Formulas II through VII.

Formula II

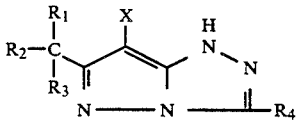

Formula III

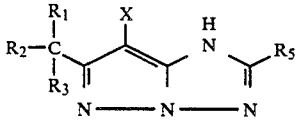

Formula IV

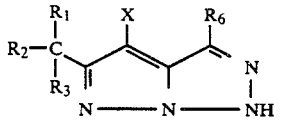

Formula V

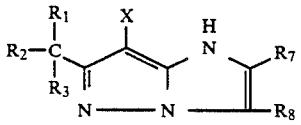

Formula VI

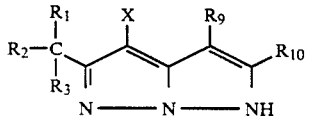

Formula VII

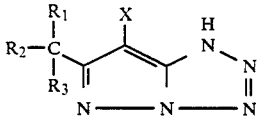

The Formulas II through VII above, $R_1$, $R_2$, $R_3$ and X have the same signification as the like symbols in the Formula I, and $R_4$, $R_5$, $R_6$ $R_7$, $R_8$, $R_9$ and $R_{10}$ represent each substituent groups.

Of the magenta couplers represented by the Formulas II through VII, preferable for use are compounds represented by the Formulas II and III and more preferable is one represented by the Formula II.

A detailed explanation will follow hereunder with respect to the substituent groups in the Formulas I through VII.

What is represented by each of $R_1$, $R_2$ and $R_3$ may be the same as well as different from each other, each representing halogen atom such as chlorine, bromine and fluorine; an alkyl group including a straight chain or branched chain alkyl group with a carbon number of 1–32, which may contain a substituent, e.g., methyl, propyl, t-butyl, hexadecyl, 3-(3-pentadecylphenoxy)-propyl, 3-(2,4-di-t-amylphenoxy)propyl, 3-(2,4-di-t-amylphenoxy)ethyl, 3-(4-di-t-amylphenoxy)propyl, and 2-[α-(3-t-butyl-4-hydroxyphenoxy)tetradecaneamido-ethyl]; a cycloalkyo group such as cyclohexyl group; an alkenyl group such as propenyl group, a cycloalkenyl group; an alkinyl group; a aryl group such as groups of phenyl, α- or β-naphthyl, 4-methylphenyl, 2,4,6-trichlorophenyl, and 4-[α(3-t-butyl-4-hydroxyphenoxy)-tetradecaneamido]-2,6-dichlorophenyl; a heterocyclic group such as pyridyl, thienyl and quinolyl group; an acyl group such as acetyl and benzolyl group, a sulfonyl group; a sulfinyl group; a phosphonyl group such a butyloctylphosphonyl group; a carbamoyl group; a sulfamoyl group; a cyano group; a spiro-compound residue such as spiro(3,3)heptane-1-yl group; a bridged hydrocarbon compound residue such as bicyclo(2,2,1-)heptane-1-yl group; an alkoxy group such as groups of methoxy, ethoxy, proppxy, isopropoxy, and butoxy, an aryloxy group such as phenoxy group; heterocyclic-oxy such a 1-phenyltetrazolyloxy group; a siloxy group such as trimethylsiloxy group; an acyloxy group such as acetyloxy group; a carbamoyloxy group; an amino group; an acylamino such as groups of acetylamino, benzamido, 3-(2,4-di-t-amylphenoxy)butylamido, and 3-(3-pentadecylphenoxy)butylamido; a sulfonamido group such as methanesulfonamido group; an imido group such as succinimido group; an ureido group; a sulfamoylamino group; an alkoxycarbonylamino group such as groups of methoxycarbonylamino and tetradecyloxycarbonylamino; an aryloxycarbonylamino group such as phenoxycarbonylamino group; an alkoxycarbonyl group such as methoxycarbonyl group; an aryloxycartonyl group such as phenoxycarbonyl group; an alkylthio group such as hexylthio group and dodecylthio group; an arylthio group such as phenylthio group; or a heterocyclicthio group such as 3-pyridylthio group, the groups above include ones having a substituent.

Each of $R_4$ through $R_{10}$ represents a hydrogen atom, an alkyl group including a straight chain or branched chain alkyl group with a carbon number of 1–32, which includes one having a substituent; examples are the same as for $R_1$, $R_2$ and $R_3$; an aryl group, examples are the same as for $R_1$, $R_2$ and $R_3$; a heterocyclic group, examples are the same as for $R_1$, $R_2$ and $R_3$; an acylamino group such as acetylamino group, benzamido group such as groups of (3-(2,4-di-t-amylphenoxy)butylamido, 3-(3-pentadecylphenoxy)-butylamido; an alkylamino group such as groups of methylamino, diethylamino and dodecylamino; an anilino group such as groups of phenylamino, 2-chloro-5-tetradecaneamidophenylamino, and 4-[α(3-t-butyl-4-hydroxyphenoxy)-tetradecaneamido]anilino; an alkoxycarbonyl group such as groups of methoxycarbonyl, and tetradecyloxycarbonyl; an alkylthio group such as groups of hexylthio and dodecylthio.

Typical examples of the compounds of Formula I of the present invention will be shown hereunder on the understanding that they shall in no way restrict the scope of the invention.

1

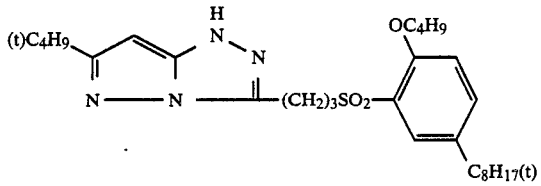

2

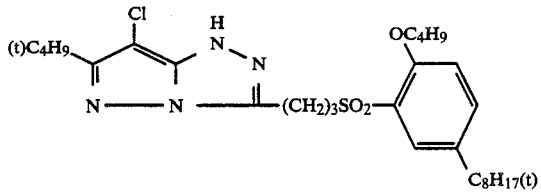

3

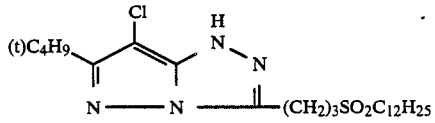

4

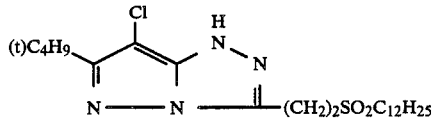

5

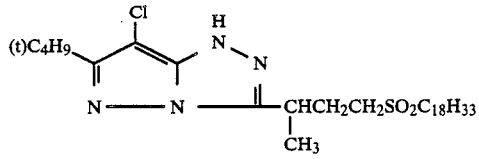

6

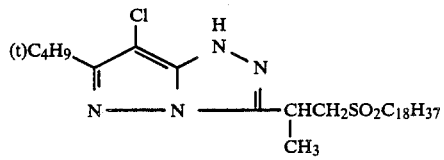

7

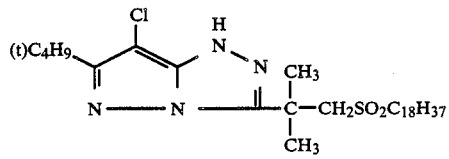

8

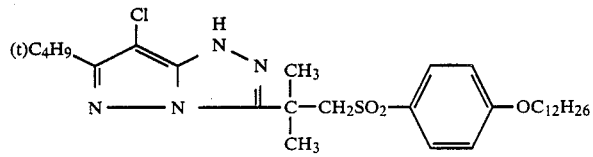

9

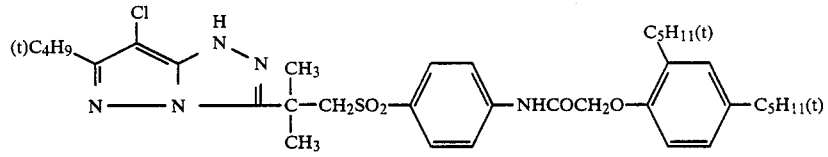

-continued
10
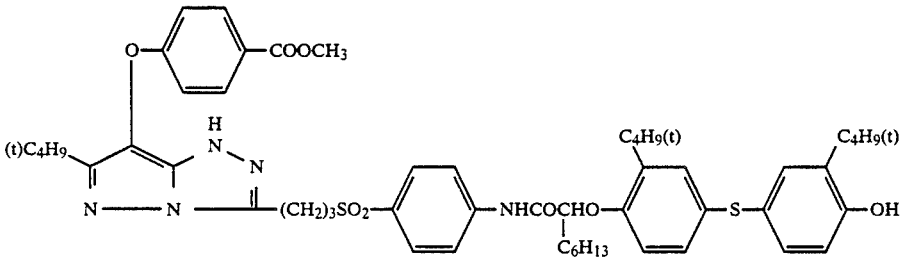
11
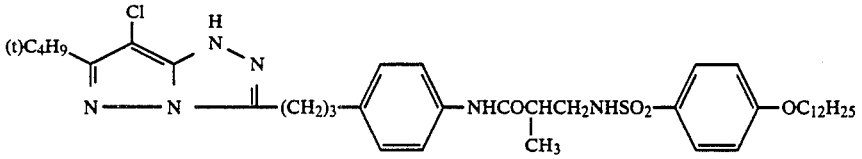
12
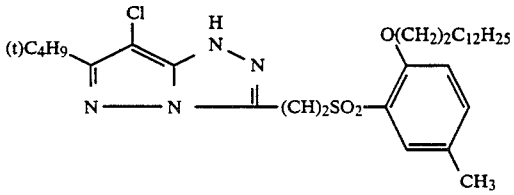
13
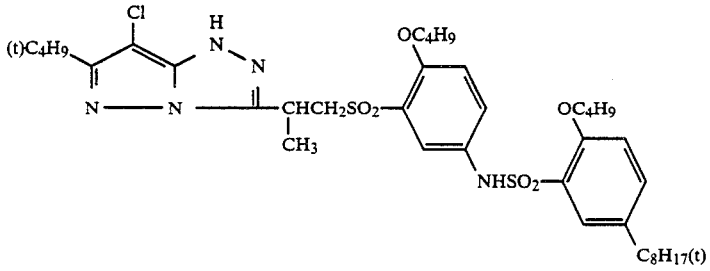
14
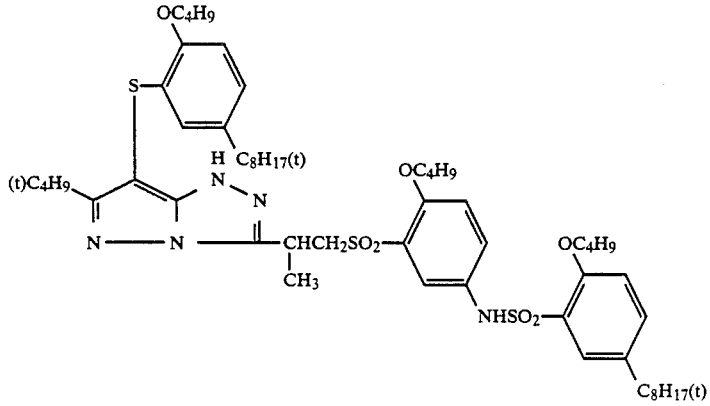
15
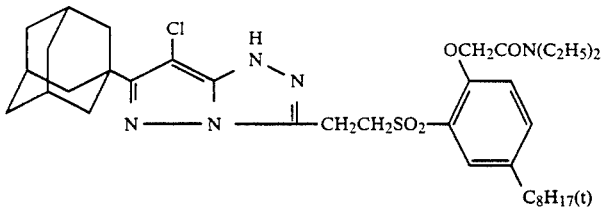

-continued
16
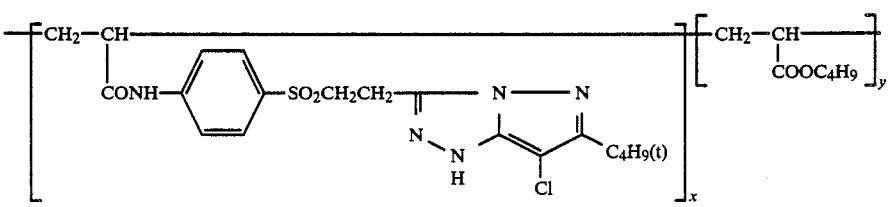
x:y = 50:50
17
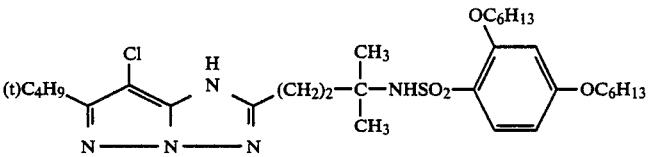
18
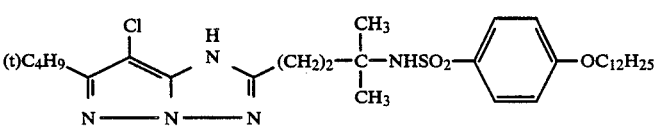
19
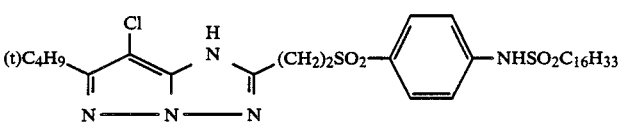
20
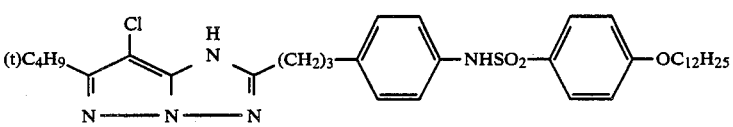
21
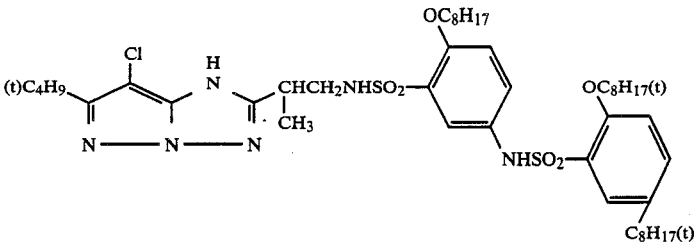
22
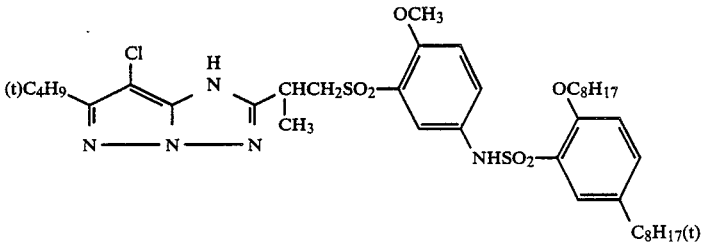
23
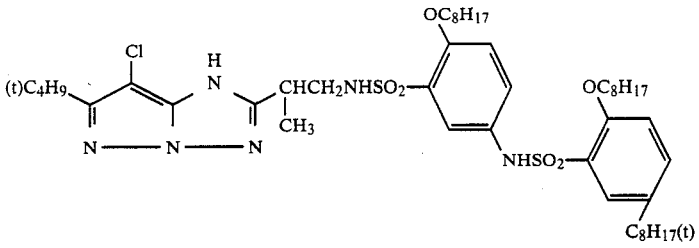

-continued

24

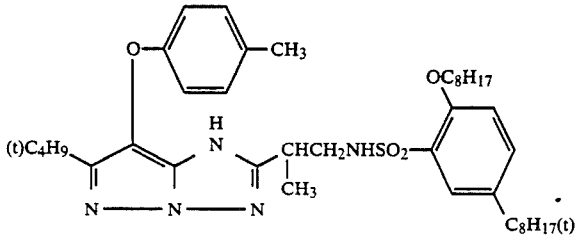

25

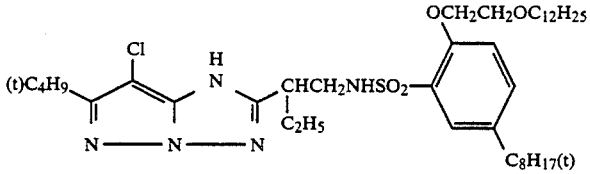

26

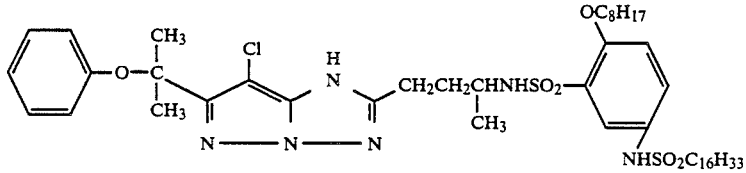

The compound in this invention which is used with a magenta coupler represented by the aforementioned Formula I and designed to deactivate the oxidation product of a color developing agent, hereinafter referred to as "quencher", is a rapid reacting compound with a relative reacting rate of 1.6 or more. This rapid reacting quencher may form a color upon reacting with the oxidation product of a color developing agent but should preferably turn substantially colorless in the image upon processing treatments.

The relative reacting rate herein considered is what can be determined as a relative value obtainable by measuring the dye density of the color image that coupler N forms after the quencher has been mixed with said coupler, incorporated with a silver halide emulsion, and subjected to color development.

Coupler N

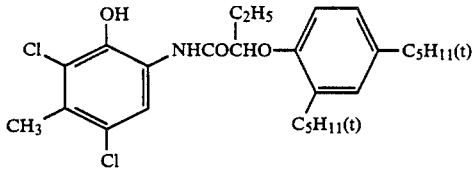

The ratio of reaction activity of a quencher with coupler N, represented as R, can be defined in a formula as $$R = \frac{DM}{DM'},$$

wherein DM represents the density of a color image of coupler N when a quencher is not used; DM' represents the density of the color image of the coupler N when a quencher is added in a quantity of 1/10 mol against coupler N.

The reaction rate of a quencher with the oxidation product of a color developing agent can be determined as a relative value by finding R for the quencher against coupler N in the above formula.

From the viewpoint of stability of preservation a quencher in this invention should preferably have R of not more than 15.

A rapid reacting quencher, when added to a green-sensitive silver halide emulsion layer, may be used preferably in quantities of $1\times10^{-4}$ to $5\times10^{-1}$ mol per 1 mol coupler, although the addition is not confined to this range. When it is added to an intermediate layer, the preferable amount of addition is within the range of $1\times10^{-7}$ to $1\times10^{-1}$ mol per $m^2$. Examples of quenchers applicable in accordance with this invention will be shown next on the understanding that they shall in no way restrict the scope of this invention. The respective R value is shown in brackets. These quenchers can be used each independently as well as in combination between two or more different quenchers.

Examples of Quenchers (Q-1)

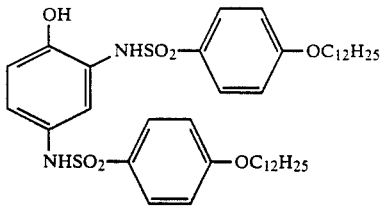

-continued
Examples of Quenchers
[1.72]
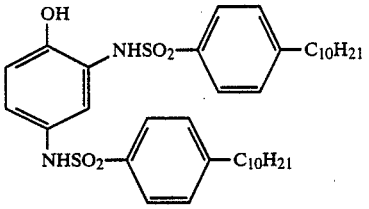
(Q-2)
[1.64]
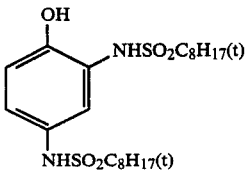
(Q-3)
[1.62]
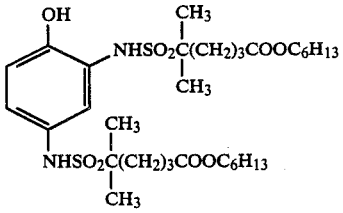
(Q-4)
[1.66]
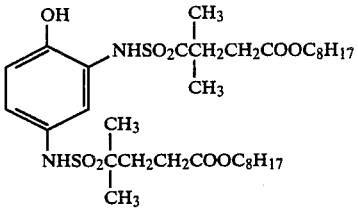
(Q-5)
[1.66]
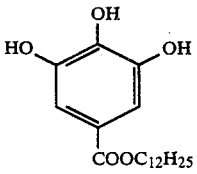
(Q-6)
[2]
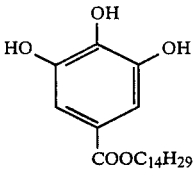
(Q-7)
[2.1]

-continued
Examples of Quenchers
(Q-8)
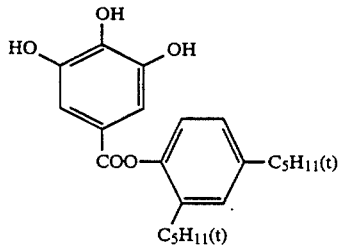
[2.4]
(Q-9)
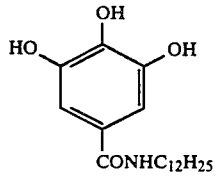
[3.16]
(Q-10)
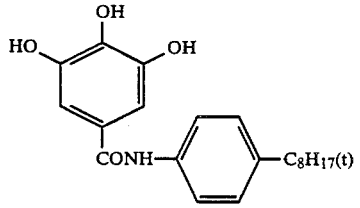
[3.70]
(Q-11)
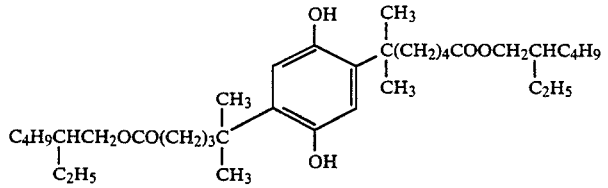
[1.62]
(Q-12)
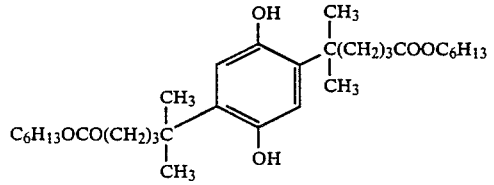
[1.60]
(Q-13)
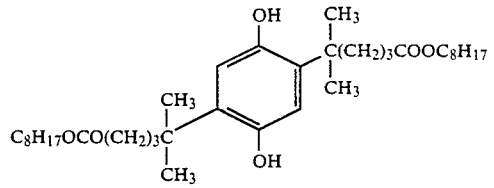
[1.64]

-continued
Examples of Quenchers
(Q-14)
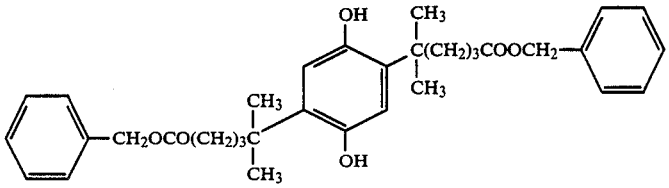
[1.62]
(Q-15)
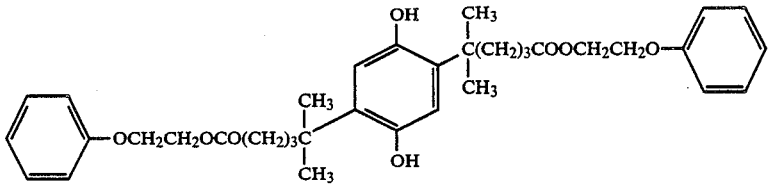
[1.68]
(Q-16)
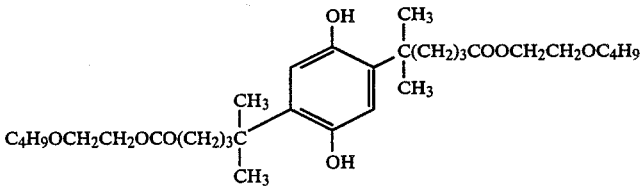
[1.72]
(Q-17)
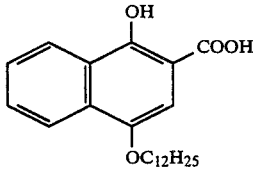
[1.92]
(Q-18)
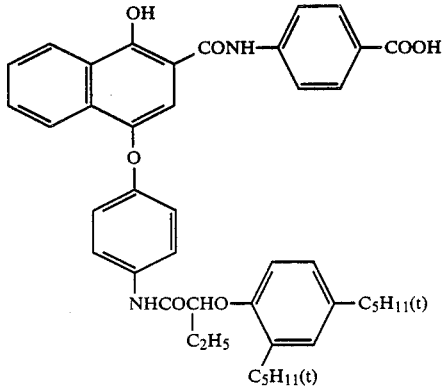
[1.96]

-continued
Examples of Quenchers
(Q-19)
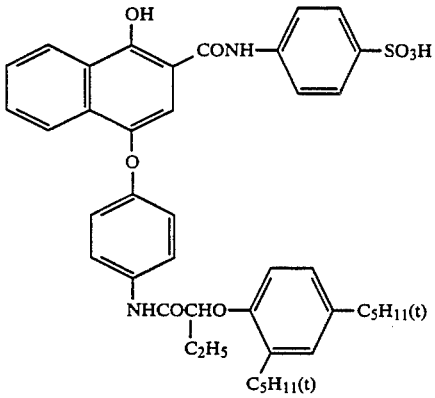
[1.94]
(Q-20)
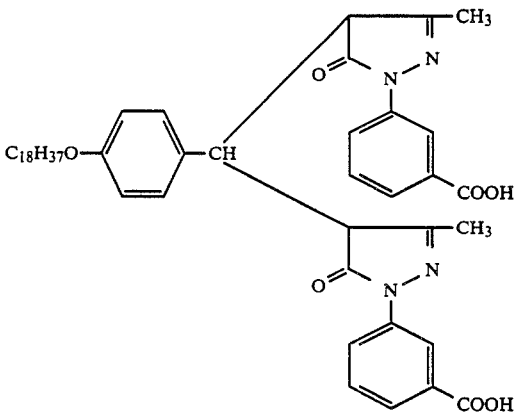
[1.78]
(Q-21)
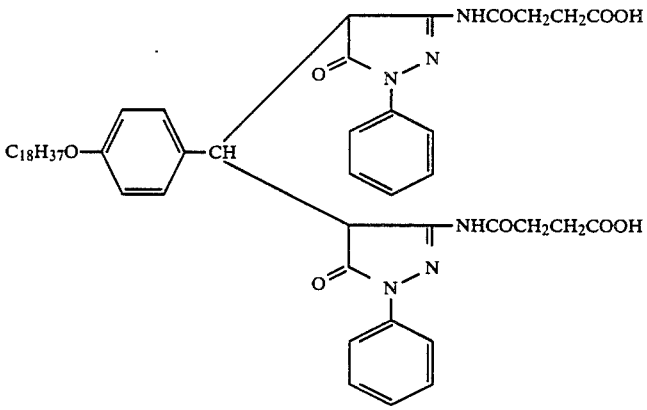
[1.74]
(Q-22)
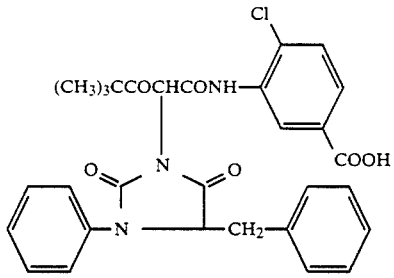

-continued
Examples of Quenchers
[1.60]
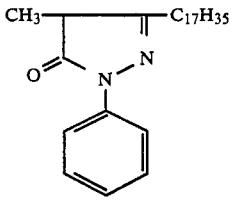
(Q-23)
[1.62]
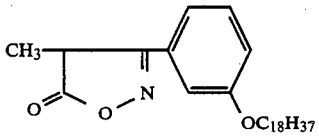
(Q-28)
[1.62]
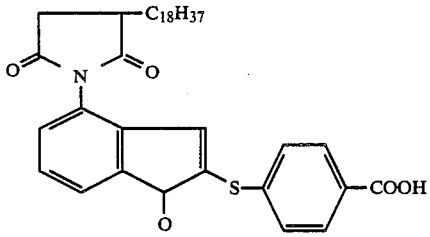
(Q-29)
[1.62]
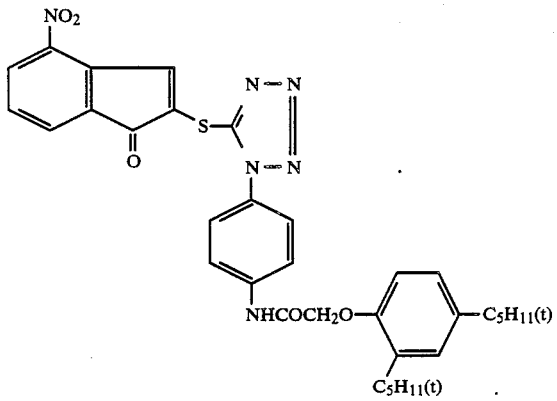
(Q-30)
[1.66]
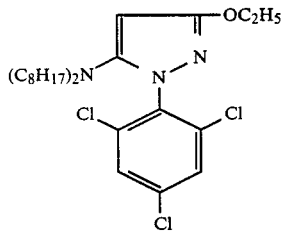
(Q-24)
[1.62]

-continued
Examples of Quenchers
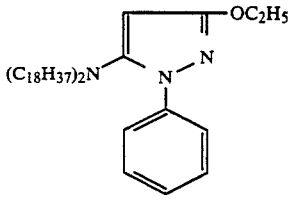
(Q-25)
[1.60]
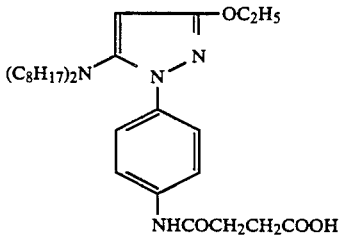
(Q-26)
[1.60]
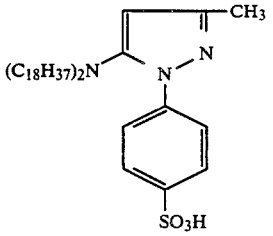
(Q-27)
[1.62]
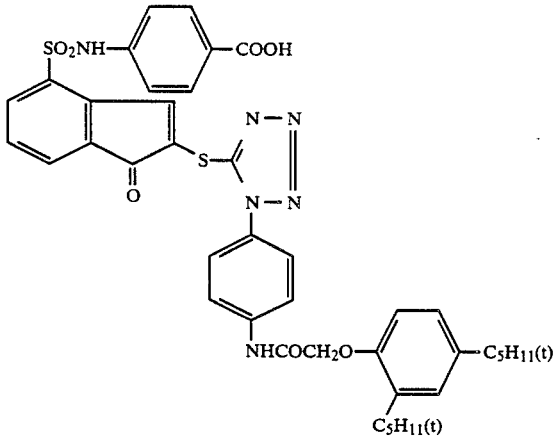
(Q-31)
[1.66]
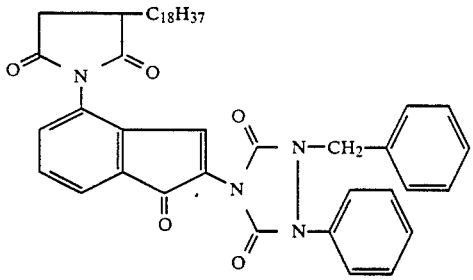
(Q-32)
[1.64]

-continued

Examples of Quenchers (Q-33)

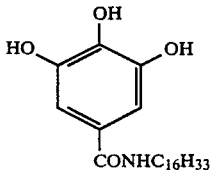

[2.86]

(Q-34)

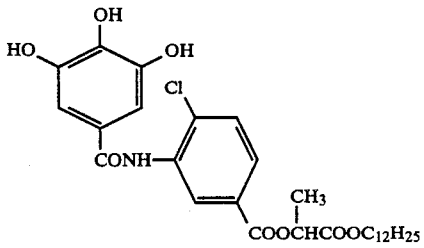

[4.0]

(Q-35)

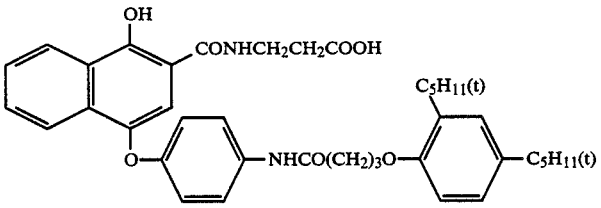

[1.92]

(Q-36)

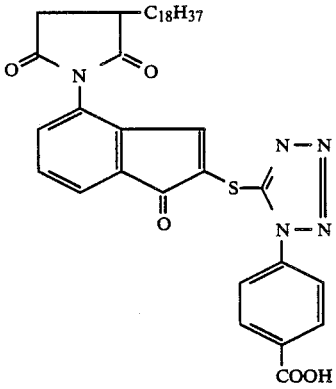

[1.62]

The silver halide grains produced in accordance with this invention have a silver chloride content of 90 mol % or more. It is preferable for the silver bromide content to be not more than 10 mol % and for the silver iodide content to be not more than 0.5 mol %. Especially preferable is the use of silver chloro-bromide with a silver bromide content within the range of 0.1 to 2 mol %.

The silver halide grains of this invention can be used singly as well as in the form of a mixture with silver halide grains with a different composition. They can also be mixed with silver halide grains with a silver chloride content of less than 90 mol % when used.

In a silver halide emulsion layer of this invention wherein silver halide grains with a silver chloride content of 90 mol % or more are contained, the silver halide grains with a silver chloride content of 90 mol % or more must be used in the proportion of not less than 60% by weight to the total content of the silver halide grains in said emulsion layer, or preferably in the proportion of not less than 80% by weight.

Each of the silver halide grains of this invention may be formed uniformly in composition from interior to exterior as well as with differences between the interior and the exterior. When the composition differs between the interior and the exterior, the composition may be made to differ in a continuous order or irregularly.

There are no specific limits to the grain size of the silver halide grains of this invention, but from considerations of photographic properties such as adaptability to rapid processing and sensitivity it is preferable for the grain size to be within the range of 0.2 to 1.6 μm, especially preferable to be within the range of 0.25 to 1.2 μm. The grain size can be measured by any of the ordinary methods used in the related technical field. Methods typically applicable to this measurement are described in "Analysis of Grain Size" by Loveland, ASTM Symposium on Light Microscopy, 1955 (pages 94–122) and "Theory of Photographic Processes" by Mees & James, 3rd Ed. Chapter 2), Macmillan (1966).

The grain size can be measured on the basis of the projected area of the grains or by approximation of the diameter. Where the grains are substantially uniform in shape, the grain size distribution can be represented fairly accurately in terms of diameter or projected area.

The grain size distribution of the silver halide grains of this invention can be polydispersed as well as monodispersed. It is preferable for the silver halide grains to be monodispersed in grain size distribution with a coefficient of variation of not more than 0.22, preferably with one of not more than 0.15.

The silver halide grains to be formed into an emulsion of this invention can be obtained by any of the acid process, neutral process and ammonia process. The grains can be produced by a method for continuous growth at a time as well as by a stepwise method comprising formation of the seeds and growth of the grains. The method for the formation of the seeds and the method for the growth of the grains can be the same as well as different from each other.

The soluble salt of silver and the soluble halide can be reacted with each other by any of the normal precipitation method, reverse precipitation method, and double-jet precipitation method, by their combination, or the like. It is preferable, however, to use the double-jet precipitation method for the reaction Applicable also is the pAg-controlled double-jet method, which is a variation of the double-jet precipitation method, described, for example, in Japanese Patent O.P.I. Publication No. 54-48521/1979.

For preparation of the silver halide grains a silver halide solvent, such as a thioether, can be used as occation requires. Compounds such as a mercapto group-containing compound, a nitrogen-containing heterocyclic compound, and a sensitizing dye can be added during formation of the silver halide grains or after completing the formation of the grains. The silver halide grains of this invention can be made to assume any shape arbitrarily; one preferable shape is a cube with {100} faces as crystal faces; the grains can be formed as octahedrons, tetradecahedrons, dodecahedrons, and the like, and also as grains having twin faces.

The silver halide grains of this invention can be made in a single shape as well as in a mixture of various shapes.

Silver halide grains of this invention can be made to contain metal ions in the interior and/or in the surface of each grain by adding the metal ions during the grain-forming process and/or during the growth process by introducing cadmium salt, zinc salt, lead salt, thallium salt, iridium salt or a complex thereof, rhodium salt or a complex thereof, or iron salt or a complex thereof. Also by placing the grains in a suitable reductive environment reduced sensitizing nuclei can be imparted to the grains in the interior and/or in the surface.

Useless soluble salts contained in an emulsion containing silver halide grains of this invention, hereinafter referred to as "emulsion of this invention", can be removed therefrom after completion of the growth of the silver halide grains or may be left unremoved. The removal of the useless salts can be carried out in accordance with the method described in Research Disclosure No. 17643.

It is preferable for an emulsion of this invention to be formed of silver halide grains on whose surfaces latent images are mainly formed, but grains in whose interior latent images are formed are also applicable.

Silver halide grains of this invention can be sensitized by means of gold compounds. Gold compounds applicable in accordance with this invention may have an oxidation number of +1 as well as +3. Many kinds of gold compounds are used. Examples of such gold compounds typically useful for the purpose are chloroaurate, potassium chloroaurate, auric trichloride, potassium auricthiocyanate, potassium iodoaurate, tetracyanoauric azide, ammonium aurothiocyanate, pyridyltrichlorogold, gold sulfide, and gold selenide.

The quantities in which gold compounds are added vary according as the condition changes. Ordinarily they may be used in quantities of $10^{-8}$ to $10^{-1}$ mol per mol of silver halide, or preferably in quantities of $10^{-7}$ to $10^{-2}$ mol per mol of silver halide.

In sensitizing an emulsion of this invention, a reductive sensitizing method using a reducing substance, a noble metal-based sensitizing method by the use of noble metal compounds, and the like can be introduced in combination.

Chalcogen sensitizing agents are applicable in this invention. The words "chalcogen sensitizing agents" refer as a general term to sulfur sensitizers, selenium sensitizers, and tellurium sensitizers, of which the sulfur sensitizer and selanium sensitizer are preferable for use. Examples of sulfur sensitizing agents are thiosulfate, allylthiocarbazide, thiourea, allylisothiocyanate, cystine, p-toluenethiosulfonate, and rhodanine. Some more sulfur sensitizers applicable for the purpose are described in the specifications of U.S. Pat. Nos. 1,574,944, 2,410,689, 2,278,947, 2,728,668, 3,501,313 and 3,656,955, West German OLS Patent No. 1,422,869, Japanese Patent O.P I. Publication Nos. 56-24937/1981 and 55-45016/1980. The quantities in which sulfur sensitizing agents are added vary in a wide range according as various conditions, such as the pH, temperature, and size of the silver halide grains, change. Ordinarily it is preferable to use them in quantities of approx. $10^{-7}$ mol to approx. $10^{-1}$ mol per mol silver halide.

An emulsion layer of a photosensitive silver halide photographic material formed in accordance with this invention shall contain a dye-forming coupler which, in the color developing process, forms a dye by reacting, in the mode of coupling, with the oxidation product of a developer based on an aromatic primary amine, such as a p-phenylenediamine derivative and an aminophenol derivative.

Ordinarily, the dye-forming couplers for the respective emulsion layers are so selected as to form dyes which absorb the respective spectral region of light to which the respective emulsion layer is sensitive, hence a yellow dye-forming coupler for the blue-sensitive emulsion layer, a magenta dye-forming coupler for the green-sensitive emulsion layer, and a cyan dye-forming coupler for the red-sensitive emulsion layer. However, combinations differing from the above-mentioned ordinary practice can be introduced in making a photosensitive silver halide color photographic material in order to suit the product to a specified purpose.

Examples of yellow dye-forming couplers are acylacetoamide-type couplers such as benzoylacetoanilides and pivaloylacetoanilides; examples of magenta dye-forming couplers are, basides the couplers of the present invention, 5-pyrazolone-type couplers, pyrazolobenzimidazole-type couplers, and open-chain acylacetonitrile-type couplers; and examples of cyan dye-forming couplers are naphthol-type couplers and phenol-type couplers.

It is desirable for each of such dye-forming couplers to contain in the molecule a ballast group, which is a group with a carbon number of not less than eight and makes the coupler non-diffusible. Both tetravalent couplers and bivalent couplers are useful, a tetravalent coupler being one which requires four silver ions to be reduced to form one molecule of the relevant dye and a bivalent coupler being one which requires two silver ions to be reduced to form a dye molecule.

A color photographic light-sensitive material of this invention may contain an anti-color fogging agent in order to prevent a color contamination, and degradation in sparkness and graininess of image from occurring between layers of emulsions, between layers sensitive to the same color and/or between layers sensitive to different colors, as a result of migration of the oxidation product of the color developing agent or of the election transfer agent.

The anti-color fogging agent mentioned above can be contained in emulsion layers as well as in an intermediate layer which may be provided between two adjoining emulsion layers.

An image stabilizer may be used in a color photographic light-sensitive material of this invention in order to prevent the color image from deteriorating.

A color photographic light-sensitive material of this invention can be provided with auxiliary layers, such as a filter layer, antihalation layer, and anti-irradiation layer. Such auxiliary layers and/or emulsion layers may contain dyes which effuses from the photographic material or is bleached during the color developing process.

The structural layers of a color photographic light-sensitive material of this invention may contain various photographic additives, such as ultraviolet absorbent, antistatic agent, development accelerator, surface-active agent, water-soluble anti-irradiation dye, monochromatic developing agent, hardener, layer property-improving agent, and fluorescent whitening agent.

In the embodiment of this invention, useful photographic substances are dispersed in a finely divided state in a hydrophilic colloid in an oil-in-water system, which is called as an oil-protected state. The words "useful photographic substances" are used herein to mean compounds which are insoluble or difficult to dissolve in water, such as ultraviolet absorbent, anti-fading agent for color images, color image-forming coupler, antifogging agent, anti-color contamination agent, and redox compound.

To prepare the oil in water type emulsion, a known method applicable to the process of dispersing hydrophobic additives such as couplers can be used. Ordinarily, the additive is dissolved in a high boiling organic solvent with a boiling point above approx. 150° C., where necessary, in its preparation wherein a low boiling organic solvent and/or a water-soluble organic solvent are combined therewith. Then the solution is emulsified through dispersion in a hydrophilic binder, such as an aqueous solution of gelatin, with the help of a surface-active agent and by the use of a dispersing means such as stirrer, homogenizer, colloid mill, flow-jet mixer, and ultrasonic device, and the resulting emulsion can be added to a hydrophilic colloidal layer to complete the layer. A step to eliminate the low boiling organic solvent from the dispersion liquid simultaneously with the dispersion or after complition of the dispersion can be incorporated in the process.

In the practice of this invention, it is preferable to use a high-boiling organic solvent with a dielectric constant of less than 6.0. Although there is no specific lowest limit, it is preferable for the dielectric constant to be not less than 1.9. Examples of such organic solvents are esters, such as a phthalic ester and a phosphoric ester, organic acid amides, ketones, and hydrocarbon compounds, each with a dielectric constant of less than 6.0.

A high-boiling organic solvent preferable for the use in this invention is a kind whose vapor pressure at 100° C. is not more than 0.5 mmHg. Especially phthalic esters and phosphoric esters are preferable among high-boiling organic solvents applicable. A mixture of two kinds or more of organic solvents is also applicable, provided that the dielectric constant of the mixture is less than 6.0. The dielectric constant in this invention refers to a value determined at 30° C. Examples of high-boiling organic solvents which are suited to combination between two or more are dibutyl phthalate, dimethyl phthalate, tricresyl phosphate, and tributyl phosphate.

The undermentioned Formula HA represents a phthalic acid ester which is applicable advantageously in accordance with this invention.

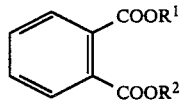

Formula HA wherein $R^1$ and $R^2$ each represent an alkyl group, an alkenyl group or an aryl group; provided the groups represented by $R^1$ and $R^2$ should have a carbon atom number of 9–32, or preferably 16–24, in total.

The alkyl group represented by $R^1$ and $R^2$ in the Formula HA may be of a straight chain or a branched chain, examples being butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, and octadecyl group.

Examples of aryl groups represented by $R^1$ and $R^2$ are phenyl group and naphthy group, and examples of alkenyl groups are hexenyl group, heptenyl group, and octadecenyl group. The alkyl group, alkenyl group or aryl group represented by $R^1$ or $R^2$ may contain a single or a plurality of substituent groups, examples of such substituents in the alkyl group and the alkenyl group being halogen atom, alkoxy group, aryl group, aryloxy group, alkenyl group, and alkoxycarbonyl group, and examples of substituents in the aryl group are halogen atom, alkyl group, alkoxy group, aryl group, aryloxy group, alkenyl group, and alkoxycarbonyl group. Any two or more of such substituents may be contained in an alkyl group, an alkenyl group, or an aryl group for $R^1$ or $R^2$.

The undermentioned Formula HB represents a phosphoric acid ester which is applicable advantageously in accordance with this invention.

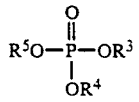

Formula HB wherein $R^3$, $R^4$ and $R^5$ each represent an alkyl group, an alkenyl group, or an aryl group; $R^3$, $R^4$ and $R^5$ altogether should have a carbon atom number of 24–54.

Examples of alkyl groups represented by $R^3$, $R^4$ and $R^5$ in the Formula HB are butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, and nonadecyl group.

The alkyl group, alkenyl group or aryl group in the general Formula HB may have a single or a plurality of substituent groups. It is preferable to have an alkyl group for $R^3$, $R^4$ and $R^5$, examples being 2-etylhexyl group, n-octyl group, 3,5,5-trimethylhexyl group, n-nonyl group, n-decyl group, sec-decyl group, sec-dodecyl group, and t-octyl group.

Examples of high boiling organic solvents in the above description will be shown hereunder on the understanding that the exemplification shall in no way confine the scope of this invention to the examples provided.

Exemplification of Organic Solvents

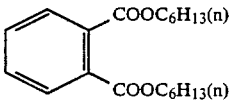

H-1

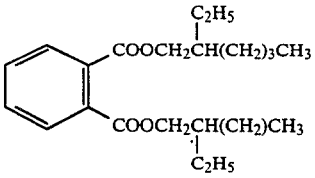

H-2

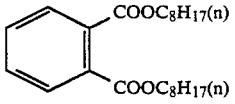

H-3

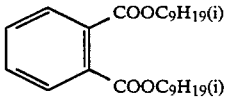

H-4

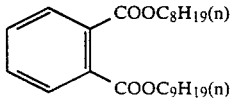

H-5

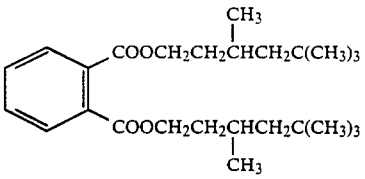

H-6

-continued

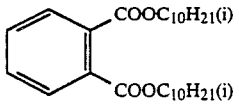

H-7

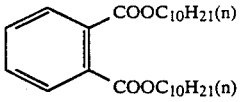

H-8

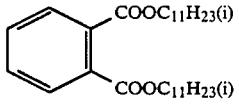

H-9

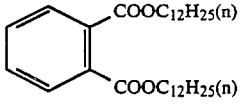

H-10

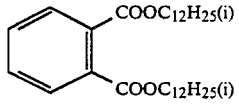

H-11

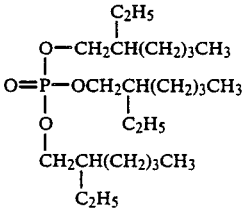

H-12

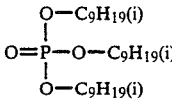

H-13

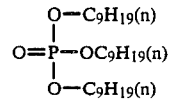

H-14

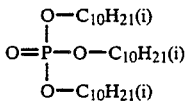

H-15

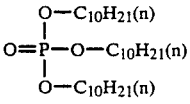

H-16

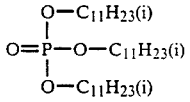

H-17

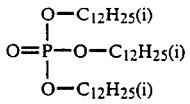

H-18

-continued

H-19

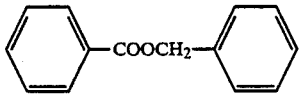

H-20

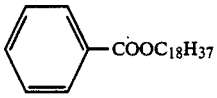

H-21

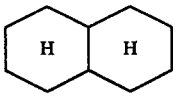

H-22

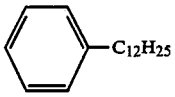

A detailed description will be provided hereunder with respect to the development procedure or image-forming procedure in the practice of the present invention.

In the development procedure practiced in accordance with this invention the color development process can be completed satisfactorily within two minutes of treating time. The treating time herein means the time interval from the contact of the photosensitive photographic material with the color developing solution to the contact of the developed material with the following bath, including the time for the removal from the first bath to the next.

In an ordinary color developing procedure, it is necessary for a color developing agent to be contained in a color developing solution. In some cases a color photographic material is made with a color developing agent incorporated therein and treated with a color developing solution containing a color developing agent or with an alkali solution or activator.

A color developing agent contained in a color developer is one based on aromatic primary amine and produced as an aminophenol derivative or p-phenylenediamine derivative, and p-phenylenediamine derivative is more preferable. Such color developing agents can be used in the form of a salt of an organic acid or an inorganic acid, for example, in the form of a hydrochloride, a sulfate, a p-toluenesulfonate, a sulfite, an oxalate, a benzensulfonate, and the like.

Such compounds of color developing agents are employed ordinarily in concentrators of approx. 0.1 g to approx. 30 g per litter of color developing solution, preferably in concentrations of approx. 1 g to approx. 15 g.

The temperature of a color developer for the development is controlled in the range of 10° C. to 65° C., preferably in the range of 25° C. to 45° C.

Aminophenol-type developing agents mentioned above are obtainable as, for example, o-aminophenol, p-aminophenol, 5-amino-2-oxy-toluene, 2-amino-3-oxy-toluene, and 2-oxy-3-amino-1,4-dimethyl-benzene.

Especially useful as color developing agents of the aromatic primary amine type are compounds based on N,N-dialkyl-p-phenylenediamine, in which the alkyl group and the phenyl group may or may not have substituent groups. Examples of such compounds, marked out as specially useful, are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, and 4-amino-N-(2-methoxyethyl)-N-ethyl-3-methylaniline-p-toluenesulfonate.

The above-mentioned color developing agents can be used in combination between two or more of them as well as singly. They can also be incorporated into a color photographic material.

For example, a color developing agent can be incorporated into a photographic material after being modified into a metallic salt as described in U.S. Pat. No. 3,719,492 or after being modified into a Schiff salt as described in U.S. Pat. No. 3,342,559 and in Research Disclosure No. 15159 (1976) or as a dye precursor as described in Japanese Patent O.P.I. Publication Nos. 58-65429/1983 and 58-24137/1983 or as a precursor of color developing agent as described in U.S. Pat. No. 3,342,597. In such cases it is also practical to process the silver halide color photographic light-sensitive material with an alkali solution or activator in place of a color developer, the alkali solution treatment immediately followed by bleaching-fixing treatment.

A color developing solution in the embodiment of this invention can be prepared by incorporation of alkalies ordinarily used in developers, such as sodium hydroxide, potassium carbonate, sodium phosphate, potassium hydroxide, ammonium hydroxide, sodium carbonate, sodium metaborate or sodium borate. The developer may contain various additives, such as benzylalcohol, alkali halide such as potassium bromide and potassium chloride, development control agent such as citrazinic acid, hydroxylamine as a preservative, polyethyleneimine, glucose, sulfite, defoaming agent, surface-active agent, organic solvent such as methanol, N,N-dimethylformamide, ethylene glycol, diethylene glycol or dimethylsulfoxide, all as the occasion may require.

The color developing solution have the pH ordinarily over 7, preferably within the approximate range of 9 to 13.

Ordinarily, the bleaching process follows the development in the processing of a silver halide color photographic light-sensitive material. The bleaching process can be carried out simultaneously with the fixing process in the mode of bleach-fixing as well as separately from the fixing process, but it is preferable for both the bleaching and fixing processes to be carried out by a single bath, called bleach-fixing bath. A pH range of 4.5 to 6.8 is preferable for a bleach-fixer prepared in accordance with this invention.

Said bleach-fixer is prepared by introducing a metal complex salt of an organic acid as a bleaching agent. This metal complex salt reconverts metallic silver, which has been produced as a result of the development, to a silver halide by oxidation. The metal complex salt included an organic acids, such as aminopolycarboxylic acid, oxalic acid or citric acid, coordinated with a metallic ion, such as one of iron, cobalt or copper. Polycarboxylic acid and aminopolycarboxylic acid are as organic acids preferably suited to forming metal complex salts referred to above. It is effective as well to employ polycarboxylic acid or aminopolycarboxylic acid in the form of an alkali metal salt, an ammonium salt or a water-soluble amine salt. Typical examples of these are (1) ethylenediaminetetraacetic acid
(2) nitrilotriacetic acid
(3) iminodiacetic acid
(4) disodium ethylenediaminetetraacetate
(5) tetratrimethylammonium ethylenediaminetetraacetate
(6) tetrasodium ethylenediaminetetraacetate
(7) sodium nitrilotriacetate Besides the bleaching agent of a metal complex salt of organic acids as described above, the bleach-fixer may contain various additives. It is especially desirable that the additives include an alkali halide or an ammonium halide as rehalogenation agent, such as potassium bromide, sodium, sodium chloride and ammonium bromide, a metal salt and a chelating agent. The bleach-fixer may furthermore contain such additives as are ordinarily employed in a bleaching solution, such as alkylamines, polyethylene oxides, and pH buffers (e.g., borate, oxalate, acetate, carbonate and phosphate), as the occasion may require.

The fixer or the bleach-fixer may contain one kind or more of sulfites and pH buffers, examples of the sulfites being ammonium sulfite, potassium sulfite, ammonium bisulfite, potassium bisulfite, sodium bisulfite, ammonium metabisulfite, potassium metabisulfite, and sodium metabisulfite and examples of the pH buffers being boric acid, borax, sodium hydroxide, potassium hydroxide, sodium carbonate, potassium carbonate, sodium bisulfite, sodium bicarbonate, potassium bicarbonate, acetic acid, sodium acetate, and ammonium hydroxide.

Where the bleach-fixer (bath) is replenished in carrying on the process in the embodiment of this invention, thiosulfate, thiocyanate, sulfite, etc. may be added directly to the bath as well as first to the replenisher and then altogether to the bath.

In order to enhance the activity of the bleach-fixer in the embodiment of this invention, the bleach-fixing bath as well as the bleach-fixer replenisher in the storage tank, if necessary, can be aerated with air or oxygen or suitable oxidizing agent, such as hydrogen peroxide, bromate or persulfate, may be added to the bleach-fixer as the occation may require.

The processing procedure of this invention comprises primarily steps of color devlopment, bleach-fixing, and washing or stabilizing process (stabilizing treatment without water washing).

The treatment using a stabilizing solution for non-water washing treatment is carried out at temperatures of 15° to 60° C., or preferably in the range of 20° to 45° C.

EXAMPLES

The present invention will now be described in detail hereunder with reference to examples on the understanding that this exemplification shall in no way confine the scope of this invention to the examples.

EXAMPLE 1

Dispersions of various couplers with compositions as specified in Table 1 were prepared by the undermentioned methods; the dispersions obtained were mixed respectively with 500 g of green-sensitive silver halide emulsion which was prepared by the undermentioned method and, after adding to the respective mixture 10 ml of sodium salt of 10% 2,4-dihydroxy-6-chloro-s-triazine as hardener, the mixtures was coated on a polyethylene-coated support and dried, finally forming samples 1 through 26.

(Preparation of dispersions of couplers)

Forty grams of coupler, shown in Table 1, was dissolved in a mixed solvent of 40 g of high boiling organic solvent shown in Table 1 and 100 ml of ethyl acetate and, after adding the solution to 300 ml of 5% aqueous gelatin solution containing sodium dodecylbenzensulfonate, the solution was formed into a dispersion of coupler by dispersing by means of an ultrasonic homogenizer.

(Preparation of silver halide emulsion)

EM-1

An aquious solution of silver nitrate and an aqueous solution of sodium chloride were added to an aqueous solution of inactive gelatin by double jet method and mixed with stirring under control of the temperature at 60° C., pH at 3.1, and pAg at 7.8.

The mixture was desalted by an ordinary method to form EM-1.

EM-1 was a monodisperse emulsion of silver chloride grains in the form of cubes with an average grain size of 0.5 μm.

EM-2

An aquious solution of silver nitrate and an aqueous solution of halide, solution of mixture of potassium bromide and sodium chloride, were added to an aqueous solution of inactive gelatin by double jet method and mixed under control of the temperature at 60° C., pH at 3.0, and pAg at 7.8. in a manner similar to the method described in Japanese Patent O.P.I. Publication No. 59-45437/1984.

The mixture was desalted by an ordinary method to form EM-2.

EM-2 was a monodisperse emulsion of silver chlorobromide grains in the form of tetradecahedrons with a silver bromide content of 90 mol % and an average grain size of 0.5 μm.

EM-1 and EM-2 were chemically sensitized under the condition below to form green-sensitive silver halide emulsion EMB-1 and EMB-2 respectively.

| | |
|---|---|
| Sulfur sensitizer: | Sodium thiosulfate 2.5 mg/mol AgX |
| Chlorauric acid: | $5 \times 10^{-55}$ mol/mol AgX |
| Sensitizing dye: | D-1 100 mg/mol AgX |
| Temperature: | 60° C. |
| Time: | 60 min. |

Sensitizing dye (D-1)

-continued

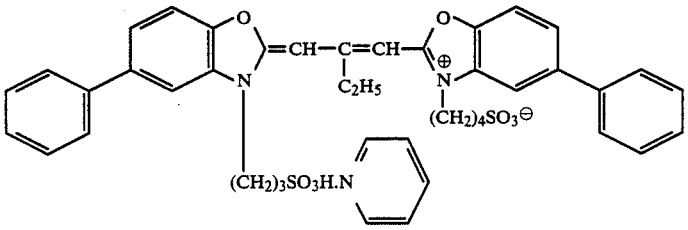

The samples thus obtained were subjected to exposure through an optical wedge by an ordinary method and to processing by the undermentioned processing procedure A or B.

| Processing procedure A | Temperature | Time |
|---|---|---|
| Color development | 33° C. | 3 min. 30 sec. |
| Bleach-fixing | 33° C. | 1 min. 30 sec. |
| Washing | 33° C. | 3 min. |

| (Color developer) | |
|---|---|
| N-ethyl-N-β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Anhydrous sodium sulfite | 2.0 g |
| Benzylalcohol | 13 ml |
| Polyethylene glycol (mean degree of polymerization 400) | 3 ml |

The total quantity was made to 1l by adding water and the pH was adjusted to 10.0 with sodium hydroxide.

| (Bleach-fixer) | |
|---|---|
| Ferric sodium ethylenediaminetetraacetate | 60 g |
| Ammonium thiosulfate | 100 g |
| Sodium bisulfite | 10 g |
| Sodium metabisulfite | 3 g |

The total quantity was made to 1l by adding water and the pH was adjusted to 7.0 with ammonia water.

| Processing procedure B | Temperature | Time |
|---|---|---|
| Color development | 35.0 ± 0.3° C. | 45 sec. |
| Bleach-fixing | 35.0 ± 0.5° C. | 45 sec. |
| Stabilizing | 30–34° C. | 90 sec. |
| Drying | 60–80° C. | 60 sec. |

| (Color developer) | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonate | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |

-continued

| | |
|---|---|
| Fluorescent whitening agent (4,4-diaminostylbenedisulfonic acid derivative) | 1.0 g |
| Potassium carbonate | 27 g |

The total quantity was made to 1l by adding water and the pH was adjusted to 10.10 with potassium hydroxide or sulfuric acid.

| (Bleach-fixer) | |
|---|---|
| Ferric ammonium ethylenediaminetetraacetate dihydrate | 60 g |
| Ethylenediaminetetraacetic acid | 3 g |
| Ammonium thiosulfate (70% water solution) | 100 ml |
| Ammonium sulfite (40% water solution) | 27.5 ml |

The total quantity was made to 1l by adding water and the pH was adjusted to 6.2 with potassium carbonate or glacial acetic acid.

| (Stabilizing solution) | |
|---|---|
| 5-chloro-2-methyl-4-isothiazolin-3-one | 1.0 g |
| Ethylene glycol | 1.0 g |
| 1-hydroxyethylidene-1,1-diphosphonate | 2.0 g |
| Ethylenediaminetetraacetic acid | 1.0 g |
| Ammonium hydroxide (20% water solution) | 3.0 g |
| Ammonium sulfite | 3.0 g |
| Fluorescent whitening agent (4,4-diaminostylbenedisulfonic acid derivative) | 1.5 g |

The total quantity was made to 1l by adding water and the pH was adjusted to 7.0 with sulfuric acid or potassium hydroxide.

After the processing, the green light-reflecting density of each treated sample was measured by means of an optical densitometer (Model PDA-65, product of Konica Corp.) and the gradation (γ value of toe portion) was determined at the specific region of the characteristic curve from the density of 0.25 to the density of 0.75.

Each sample was also left to stand on an under-glass outdoor exposure stand covered with an ultraviolet filter; after exposure to the sunlight for 15 days the residual rate at the position where an initial density of 1.0 was determined. Residual rate is expressed by $D_G/D_O \times 100$, wherein, $D_G$ is the density of green after the fading test and $D_O$ is the density of green before the fading test taken as 1.0. The results are shown in Table 1.

(Compounds used in samples)

Magenta coupler for comparison

-continued (Compounds used in samples)

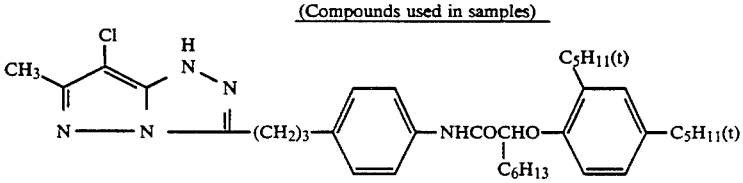

(M-1)

Quencher for comparison (Q-A)

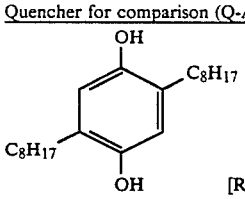

[R = 1.4]

DBP: dibutyl phthalate ($\epsilon$ = 6.4)
DOP: dioctyl phthalate ($\epsilon$ = 5.3)

TABLE 1

| Sample No. | Magenta coupler | Additives | High boiling organic solvent | Emulsion/ processing | $\gamma$ at the toe portion | Residual rate (%) |
|---|---|---|---|---|---|---|
| 1 (Comparison) | M-1 | — | DBP | EMB-2/A | 1.70 | 51 |
| 2 (Comparison) | M-1 | Q-A | DBP | EMB-2/A | 1.82 | 43 |
| 3 (Comparison) | M-1 | Q-6 | DBP | EMB-2/A | 1.95 | 23 |
| 4 (Comparison) | M-1 | — | DBP | EMB-1/B | 1.62 | 52 |
| 5 (Comparison) | M-1 | Q-6 | DBP | EMB-1/B | 1.90 | 20 |
| 6 (Comparison) | I-1 | — | DBP | EMB-1/B | 1.65 | 75 |
| 7 (Invention) | I-1 | Q-6 | DBP | EMB-1/B | 2.05 | 73 |
| 8 (Invention) | I-3 | Q-6 | DBP | EMB-1/B | 2.04 | 72 |
| 9 (Invention) | I-5 | Q-6 | DBP | EMB-1/B | 2.05 | 74 |
| 10 (Invention) | I-9 | Q-6 | DBP | EMB-1/B | 2.07 | 75 |
| 11 (Invention) | I-14 | Q-6 | DBP | EMB-1/B | 2.07 | 74 |
| 12 (Invention) | I-21 | Q-6 | DBP | EMB-1/B | 2.03 | 73 |
| 13 (Invention) | I-23 | Q-6 | DBP | EMB-1/B | 2.02 | 73 |
| 14 (Invention) | I-3 | Q-12 | DBP | EMB-1/B | 2.00 | 74 |
| 15 (Invention) | I-5 | Q-12 | DBP | EMB-1/B | 2.02 | 76 |
| 16 (Invention) | I-14 | Q-12 | DBP | EMB-1/B | 2.03 | 75 |
| 17 (Invention) | I-21 | Q-12 | DBP | EMB-1/B | 2.00 | 76 |
| 18 (Invention) | I-3 | Q-1 | DBP | EMB-1/B | 2.01 | 74 |
| 19 (Invention) | I-5 | Q-1 | DBP | EMB-1/B | 2.02 | 74 |
| 20 (Invention) | I-21 | Q-1 | DBP | EMB-1/B | 2.02 | 77 |
| 21 (Invention) | I-3 | Q-1 | DOP | EMB-1/B | 2.03 | 79 |
| 22 (Invention) | I-3 | Q-6 | DOP | EMB-1/B | 2.04 | 75 |
| 23 (Invention) | I-3 | Q-12 | DOP | EMB-1/B | 2.02 | 81 |
| 24 (Invention) | I-5 | Q-12 | DOP | EMB-1/B | 2.02 | 81 |
| 25 (Invention) | I-14 | Q-12 | DOP | EMB-1/B | 2.01 | 79 |
| 26 (Invention) | I-21 | Q-12 | DOP | EMB-1/B | 2.02 | 80 |

As is clear from Table 1, Sample 1, in which the emulsion is low in silver chloride content and which contains a magenta coupler for comparison and does not contain a quencher, shows a soft gradation at the toe portion of characteristic curve even after normal processing and also inadequacy in light fastness. Sample 2, which has a quencher for comparison, and Sample 3, which has a highly reactive quencher of this invention, do not show much improvement in gradation at the toe portion and their light fastness is rated poor. Sample 4 and Sample 5, which are high silver chloride rapid-processing variations of Sample 1 and Sample 3 respectively, show deterioration in softening. Sample 6, in which a magenta coupler of this invention is in use, shows improvement in light fastness but no improvement in softening at the toe portion. Contradistinctively, all of the samples from No. 7 to No. 20, in which the emulsions with high silver chloride contents are used together with magenta couplers and quenchers both of this invention, show substantial improvement in gradation at the toe portion and good fastness to light even after rapid processing. These results are all beyond anticipation prior to the tests. Especially the samples from No. 21 to No. 27, in which dioctyl phthalate with low dielectric constant are used as a high boiling organic solvent, show favorable results indicating a marked improvement in light fastness.

EXAMPLE 2

Sample 27 of a multicolor photographic light-sensitive material was prepared by coating a polyethylene-coated paper support with layers as shown in Table 2 in the order from the support. The samples from No. 28 to No. 41 were prepared in the same manner as Sample 27, except that the magenta couplers, the additives and the high boiling organic solvent in the third layer of Sample 27 were replaced as shown in Table 3.

All of these samples were subjected to exposure and development processing by the processing procedure B in the same manner as Sample 1 and the results were evaluated.

TABLE 2

| Layer | Composition | Coating |
|---|---|---|
| First layer (blue-sensitive emulsion) | Yellow coupler (Y-1) | 8 mg/dm$^2$ |
| | Blue-sensitive silver chloro-bromide emulsion (silver chloride 95 mol %) | 4 mg/dm$^2$ |
| | High-boiling organic solvent (DBP) | 3 mg/dm$^2$ |
| | Gelatin | 13 mg/dm$^2$ |
| Second layer (intermediate layer) | Gelatin | 9 mg/dm$^2$ |
| Third layer (green-sensitive emulsion) | Magenta coupler (M-1) | 4 mg/dm$^2$ |
| | Green-sensitive silver chloro-bromide emulsion (silver chloride 95 mol %) | 2 mg/dm$^2$ |
| | High-boiling organic solvent (DBP) | 4 mg/dm$^2$ |

TABLE 2-continued

| Layer | Composition | Coating |
|---|---|---|
| | Gelatin | 14 mg/dm$^2$ |
| Fourth layer (intermediate layer) | Gelatin | 16 mg/dm$^2$ |
| | Ultraviolet absorbent (UV-1) | 7 mg/dm$^2$ |
| Fifth layer (red-sensitive emulsion) | Cyan coupler (C-1) | 2 mg/dm$^2$ |
| | Cyan coupler (C-2) | 2 mg/dm$^2$ |
| | Red-sensitive silver chloro-bromide emulsion (silver chloride 95 mol %) | 2 mg/dm$^2$ |
| | High-boiling organic solvent (DBP) | 4 mg/dm$^2$ |
| | Gelatin | 10 mg/dm$^2$ |
| Sixth layer (intermediate layer) | Gelatin | 7 mg/dm$^2$ |
| | Ultraviolet absorbent (UV-1) | 3 mg/dm$^2$ |
| Seventh layer | Gelatin | 10 mg/dm$^2$ |

Y-1

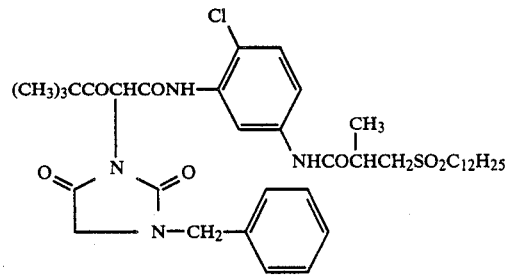

C-1

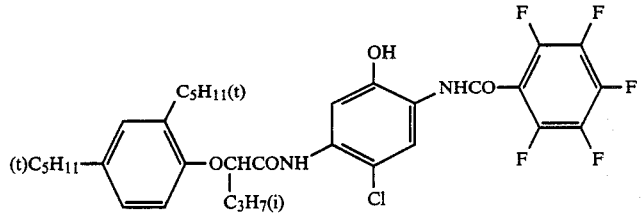

C-2

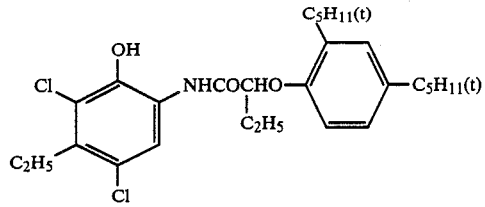

UV-1

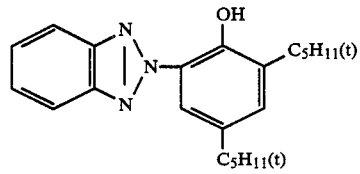

TABLE 3

| Sample No. | Magenta coupler | Additives | High boiling organic solvent | γ at the toe portion | Residual rate (%) |
|---|---|---|---|---|---|
| 27 (Comparison) | M-1 | — | DBP | 1.64 | 55 |
| 28 (Comparison) | M-1 | Q-6 | DBP | 1.88 | 22 |
| 29 (Comparison) | I-1 | — | DBP | 1.67 | 76 |
| 30 (Invention) | I-1 | Q-6 | DBP | 2.05 | 72 |
| 31 (Invention) | I-3 | Q-6 | DBP | 2.07 | 72 |
| 32 (Invention) | I-5 | Q-6 | DBP | 2.04 | 75 |
| 33 (Invention) | I-14 | Q-6 | DBP | 2.00 | 75 |
| 34 (Invention) | I-21 | Q-6 | DBP | 2.02 | 73 |
| 35 (Invention) | I-1 | Q-12 | DBP | 2.05 | 73 |
| 36 (Invention) | I-3 | Q-12 | DBP | 2.05 | 74 |
| 37 (Invention) | I-5 | Q-12 | DBP | 2.04 | 77 |

TABLE 3-continued

| Sample No. | Magenta coupler | Additives | High boiling organic solvent | γ at the toe portion | Residual rate (%) |
|---|---|---|---|---|---|
| 38 (Invention) | I-14 | Q-12 | DBP | 2.06 | 76 |
| 39 (Invention) | I-21 | Q-12 | DBP | 2.05 | 76 |
| 40 (Invention) | I-3 | Q-12 | DOP | 2.05 | 83 |
| 41 (Invention) | I-21 | Q-12 | DOP | 2.08 | 84 |

Table 3 also shows that, even in a multilayer system, only the combinations of this invention improve the gradation at the toe portion adequately without impairing the light fastness.

EXAMPLE 3

Samples were prepared in the same manner as Sample No. 40 in the example 2, except that the magenta coupler I-3 was replaced by I-1, -5, -14 and -23. After the processing and upon rating, these samples corroborated the advantages of the present invention.

What is claimed is:

1. A silver halide photographic light-sensitive material comprising a support having thereon at least one silver halide emulsion layer containing silver halide grains having a silver chloride content of not less than 90 mol %, a compound represented by the following Formula I, and a quencher capable of deactivating the oxidized product of a color developing agent, said quencher having a relative reaction rate of not less than 1.6;

Formula I

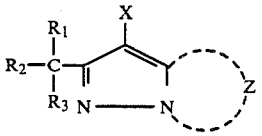

wherein R1, R2 and R3, which may be the same as or different from each other represent a radical other than a hydrogen atom; Z represents a group of non-metal atoms necessary to complete a heterocyclic ring which may have a substituent; X represents a hydrogen atom or a group capable of being split off upon reaction with the oxidized product of a color developing agent;

wherein said relative rate is defined as relative reaction rate=DM/DM' wherein DM represents the density of a color image of coupler N when the quencher is not used; DM' represents the density of the color image of the coupler N when the quencher is added in a quantity of 1/10 mol per mol of coupler N.

2. The material of claim 1, wherein said radical represented by the $R_1$, $R_2$ or $R_3$ is a halogen atom, an alkyl group, a cycloalkyl group, an alkenyl group, a cycloalkenyl, an alkinyl group, an aryl group, a heterocyclic group, an acyl group, a sulfonyl group, a carbamoyl group, a sulfamoyl group, a sulfinyl group, a phosphonyl group, a cyano group, a spirocompound residue, a bridged hydrocarbon compound residue, an alkoxy group, an aryloxy group, an heterocycloxy group, a siloxy group, an acyloxy group, a carbamoyloxy group, an amino group, an acylamino group, a sulfonamido group, an imido group, a ureido group, a sulfamoylamino group, an alkoxycarbamoylamino, an aryloxycarbamoylamino group, an alkoxycarbonyl group, an aryloxycarbonyl group, an alkylthio group, an arylthio group or a heterocyclic thio group.

3. The material of claim 1, wherein said compound represented by Formula I is represented by the following Formula II, III, IV, V, VI or VII:

Formula II

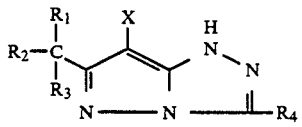

Formula III

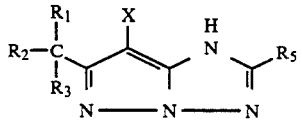

Formula IV

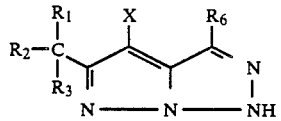

Formula V

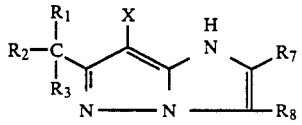

Formula VI

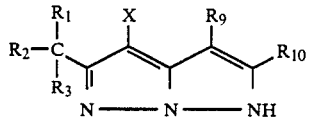

Formula VII

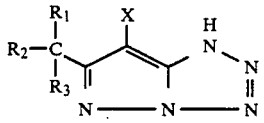

wherein $R_1$, $R_2$ and $R_3$ are the same as defined in Formula 1; and $R_4$, $R_5$, $R_6$, $R_7$, $R_8$, $R_9$ and $R_{10}$ are each a substituent.

4. The material of claim 3, wherein said $R_4$, $R_5$, $R_6$, $R_7$, $R_8$, $R_9$ and $R_{10}$ are each a hydrogen atom, an alky group, an aryl group, a heterocyclic group, an acylamino group, a benzamido group, an alkylamino group, an anilino group, an alkoxycarbonyl group or an alkythio group.

5. The material of claim 1, wherein said quencher capable of deactivating the oxidized product of a color developing agent has a relative reaction rate of from 1.6 to 15.

6. The material of claim 1, wherein said silver halide emulsion layer is a green-sensitive silver halide emulsion layer.

7. The material of claim 6, wherein said quencher capable of deactivating the oxdized product of a color developing agent is contained in said green-sensitive silver halide emulsion layer in an amount of from $1\times10^{-4}$ mole to $5\times10^{-1}$ mole per mole of the coupler.

8. The material of claim 1, wherein said silver halide grains have a silver bromide content of not more than 10 mole % and a silver iodide content of not more than 0.5 mole %.

9. The material of claim 8, wherein said silver halide grains are silver chlorobromide having a silver bromide content of from 0.1 mole % to 2 mole %.

10. The material of claim 1, wherein said silver halide emulsion layer contains a high-boiling organic solvent having a dielectric constant of less than 6.0.

11. The material of claim 10, wherein said high-boiling organic solvent has a dielectric constant of from 1.9 to 6.0.

12. The material of claim 11, wherein said high-boiling organic solvent is represented by the following Formula HA;

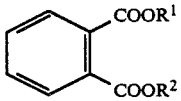

Formula HA wherein $R^1$ and $R^2$ are each an alkyl group, an alkenyl group or a aryl group, provided that a total number of carbon atoms contained in the groups represented by $R^1$ and $R^2$ is 9 to 32.

13. The material of claim 11, wherein said high-boiling organic solvent is represented by the following Formula HB;

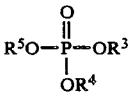

Formula HB wherein $R^3$, $R^4$ and $R^5$ are each an alkyl group, an alkenyl group or an aryl group, provided that a total number of carbon atoms contained in the groups represented by $R^3$, $R^4$ and $R^5$ is 24 to 54.

* * * * *